United States Patent [19]

York

[11] 4,343,100

[45] Aug. 10, 1982

[54] FLOOR SUPPORT FOR MOBILE SCRAPER

[75] Inventor: Lyle E. York, Peoria, Ill.

[73] Assignee: Caterpillar Tractor Co., Peoria, Ill.

[21] Appl. No.: 173,929

[22] PCT Filed: Mar. 10, 1980

[86] PCT No.: PCT/US80/00245

§ 371 Date: Mar. 10, 1980

§ 102(e) Date: Mar. 10, 1980

[87] PCT Pub. No.: WO81/02598

PCT Pub. Date: Sep. 17, 1981

[51] Int. Cl.[3] ..... E02F 9/28

[52] U.S. Cl. ..... 37/126 AE

[58] Field of Search ..... 37/126 R, 126 AC, 126 AE, 37/129, 124, 8, 126 AA, 126 A, 126 AB

[56] References Cited

U.S. PATENT DOCUMENTS

| | | | |
|---|---|---|---|
| 2,169,612 | 8/1939 | McMillan | 37/126 AC |
| 2,272,221 | 2/1942 | Mork | 37/126 AC |
| 2,368,196 | 1/1945 | Brodersen | 37/126 AA |
| 3,328,903 | 7/1967 | Campbell et al. | 37/129 |
| 3,426,457 | 2/1969 | Hancock et al. | 37/8 |
| 3,452,458 | 7/1969 | Campbell et al. | 37/8 |
| 3,872,612 | 3/1975 | Gee | 37/126 AE X |
| 4,041,625 | 8/1977 | Fisher et al. | 37/126 AE |
| 4,133,122 | 1/1979 | Girard et al. | 37/126 AE |

FOREIGN PATENT DOCUMENTS

| | | | |
|---|---|---|---|
| 560293 | 3/1944 | United Kingdom | 37/126 AB |
| 594257 | 2/1978 | U.S.S.R. | 37/126 AA |

*Primary Examiner*—E. H. Eickholt

*Attorney, Agent, or Firm*—Phillips, Moore, Weissenberger, Lempio & Majestic

[57] ABSTRACT

Heavy loads are imposed upon pivotally mounted floors (40) of mobile scrapers (10). A striking edge (41) of the floor (40) is used for leveling the discharging load when the floor (40) is open. Forces imposed on the striking edge (41) during leveling can place stress upon a pivoting apparatus (46) of the floor (40). These stresses have reduced the life of the pivoting apparatus (46). A floor support (66) for such scrapers (10) is disclosed which positively supports the floor (40) from underneath and by a frame (32) of the scraper (10). The floor support (66) reduces loading on the pivoting apparatus (46) and extends the useful life thereof.

5 Claims, 4 Drawing Figures

FLOOR SUPPORT FOR MOBILE SCRAPER

TECHNICAL FIELD

This invention relates generally to a pivotally mounted, load bearing floor, such as the floor of an earthworking scraper, and more particularly to a floor support.

BACKGROUND ART

Mobile, earthworking scrapers usually include a scraper bowl having a bottom opening and a pivotal floor which opens and closes the bottom opening. A pivoting apparatus is provided which includes a pivotal mounting structure supporting the floor on the bowl and an actuator for pivoting the floor rearwardly to an open, or load discharging, position and forwardly to a closed, or loading, position. Typically, the actuator includes one or more fluid cylinders. For example, U.S. Pat. No. 3,328,903, inventors Trevor G. Campbell, et. al., issued July 4, 1967, discloses an earthworking scraper having a floor which is pivoted by means of a lever moved by a fluid cylinder.

During loading, the floor is closed and earth is loaded into the bowl, as by an auger mechanism on the scraper, so that the weight of earth imposes primarily vertical forces on the floor. In load discharge, when the floor is pivoted to an open position, vertical forces on the floor continue to be imposed by the weight of the earth remaining in the bowl. In addition, as the scraper moves over the discharged earth and a striking edge of the floor levels the discharged earth, substantial horizontally-directed forces are imposed on the floor's striking edge.

These forces place considerable stress, not only upon the floors thereof, but also upon the pivoting apparatus. Hitherto, such stresses have caused components of the pivoting apparatus to bend or twist, resulting in an undesirable reduction in life thereof.

DISCLOSURE OF THE INVENTION

The present invention is directed to overcoming one or more of the problems as set forth above.

In one aspect of the present invention, an improved floor support is provided on a scraper having a frame, a bowl mounted thereon, and a pivotally mounted floor which is movable between an open and closed positions relative to a bottom opening of the bowl. The improved floor support comprises support means for supporting the floor from underneath and by the frame to reduce loading on a pivoting apparatus.

According, the above floor support extends the useful life of the pivoting apparatus.

BRIEF DESCRIPTION OF THE DRAWINGS

Other objects of this invention will become apparent from the following description and accompanying drawings wherein.

BEST MODE OF CARRYING OUT THE INVENTION

Figure 1:
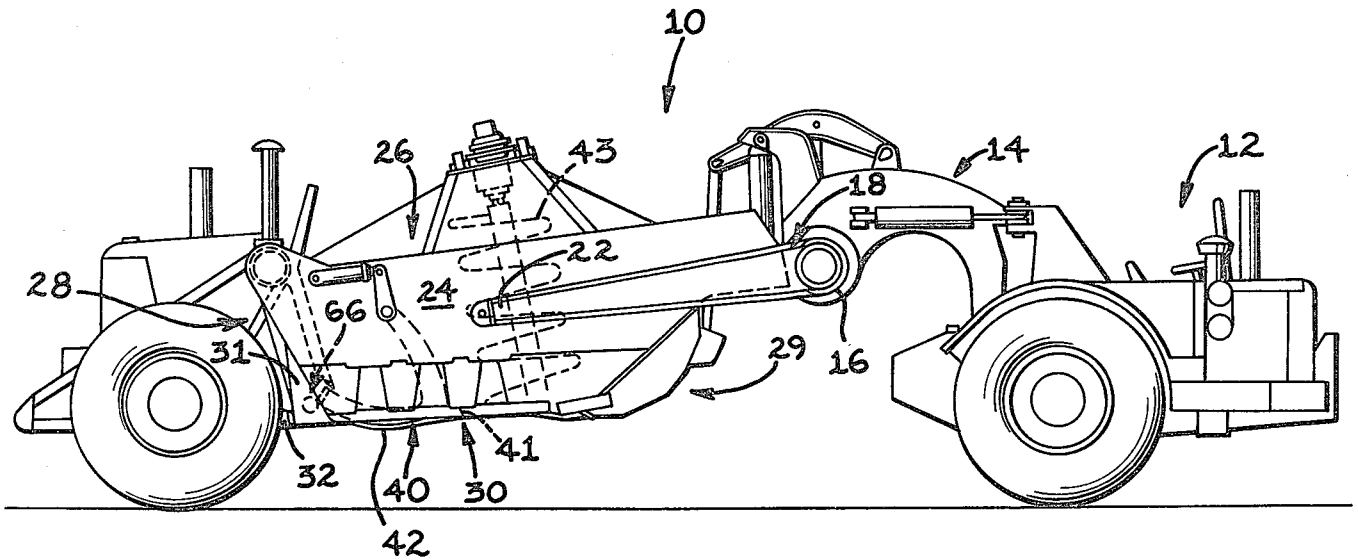
FIG. 1 is a diagramatic side elevational view of a mobile scraper including an improved floor support embodiment of the present invention.

FIG. 1 illustrates a scraper 10 comprising a tractor 12 having a gooseneck 14 extending rearwardly therefrom. A transversely disposed draft tube 16 is secured to gooseneck 14 and has a pair of draft arms 18 (only one being herein illustrated) connected thereto. Rearward end portions 22 of each draft arm 18 are pivotally connected to a respective one of a pair of upstanding sidewalls 24 of a scraper bowl 26. Scraper bowl 26 generally defines a rearward portion 28 and a forward portion 29 and has a bottom opening 30. A pair of gussets 31 are affixed to sidewalls 24 at rearward portion 28. Sidewalls 24 are opposed from each other in a generally parallel relationship and are rigidly mounted on a pair of frame rails 32 at generally rearward portion 28.

Figure 4:
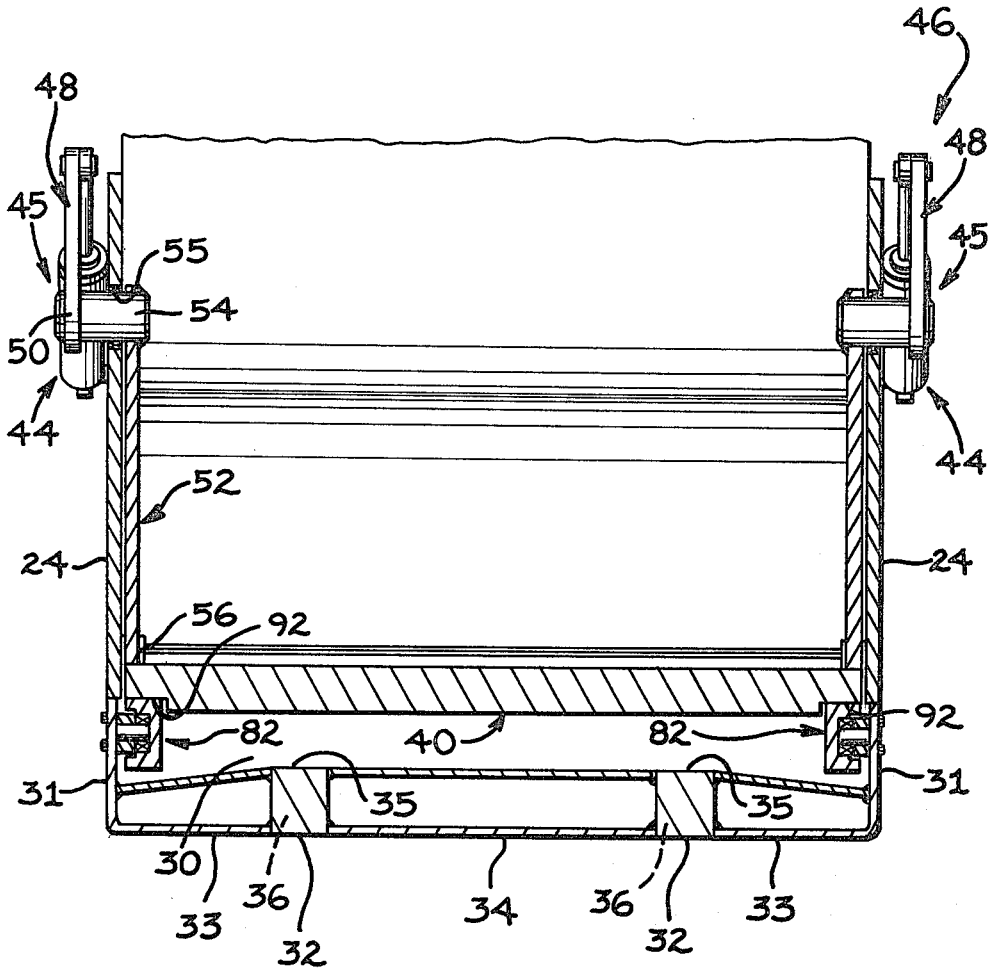

Turning to FIG. 4, it may be seen that a pair of rigid box sections 33 connect gussets 31 to frame rails 32. Frame rails 32 are tied to each other by a medial box section 34 which spans between frame rails 32. Frame rails 32 horizontally terminate adjacent bottom opening 30 at frame ends 35, and vertically define a lowermost portion 36 thereof adjacent bottom opening 30.

Figure 2:
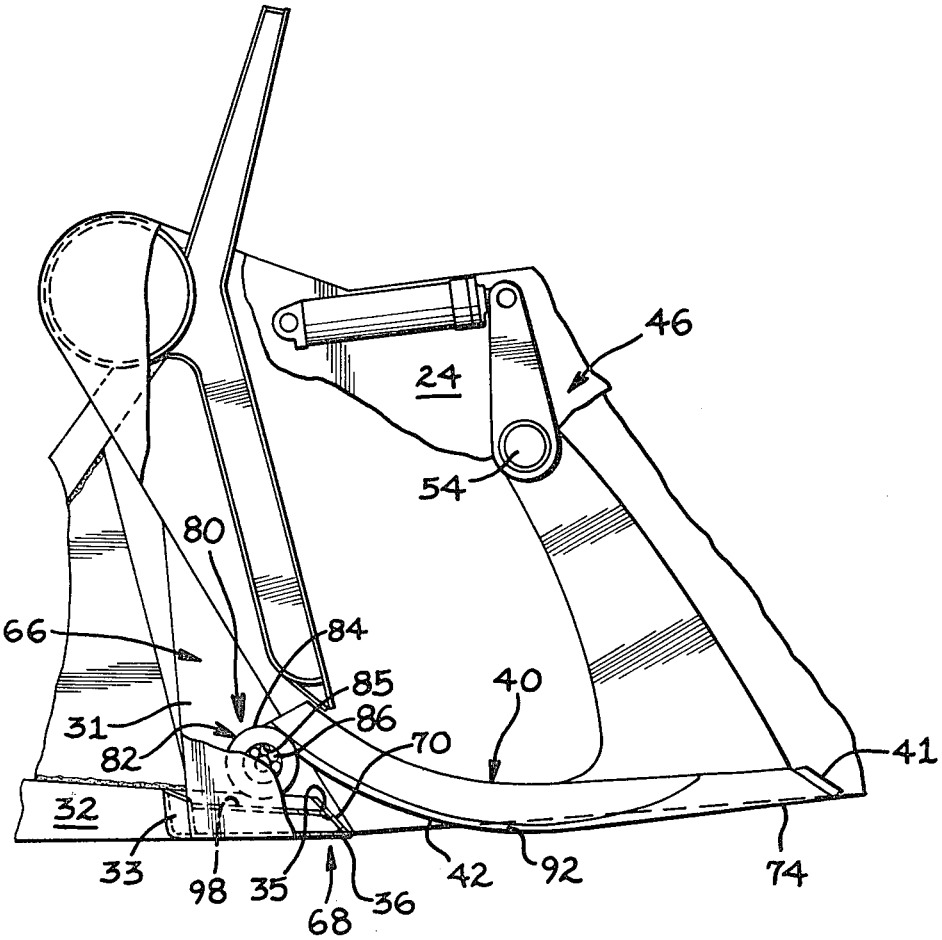
FIG. 2 is a diagramatic side elevational view, partially broken away and enlarged, of a detail of FIG. 1.

Returning to FIGS. 1 and 2, scraper bowl 26 has a pivotally mounted floor 40 disposed between sidewalls 24. Floor 40, when closed as is illustrated by FIGS. 1 and 2, extends generally horizontally to close bottom opening 30. Referring to FIG. 2, floor 40 when closed extends generally horizontally forward of frame ends 35. Floor 40 terminates in a striking edge 41 and has an underside 42. Referring to FIG. 1, an auger loading mechanism 43 is mounted in bowl 26 generally at forward portion 29.

Referring to FIG. 4, a pair of fluid cylinders 44 are each exterior a respective sidewall 24 and are associated with floor 40 so as to move floor 40 between a rearwardly open position (illustrated by FIG. 3) and a forwardly closed position (illustrated by FIGS. 1 and 2). Fluid cylinders 44 are the actuating components of a pivotal mounting structure, denoted generally as pivotal mounting structure 45, for floor 40. Fluid cylinders 44 and pivotal mounting structure 45 together comprise a pivoting apparatus 46 for floor 40.

Pivotal mounting structure 45 includes a pair of bellcranks 48. Each bellcrank 48 is the same as the other, and for convenience only one bellcrank 48 shall be described. Bellcrank 48 has a first arm 50, a second arm 52, and a pivot pin 54 therebetween. Pivot pin 54 is inserted through a bore 55 in sidewall 24. Thus, first arm 50 is outboard of sidewall 24 whereas second arm 52 is inside sidewall 24. A lower end 56 of second arm 52 is connected to floor 40.

Figure 3:
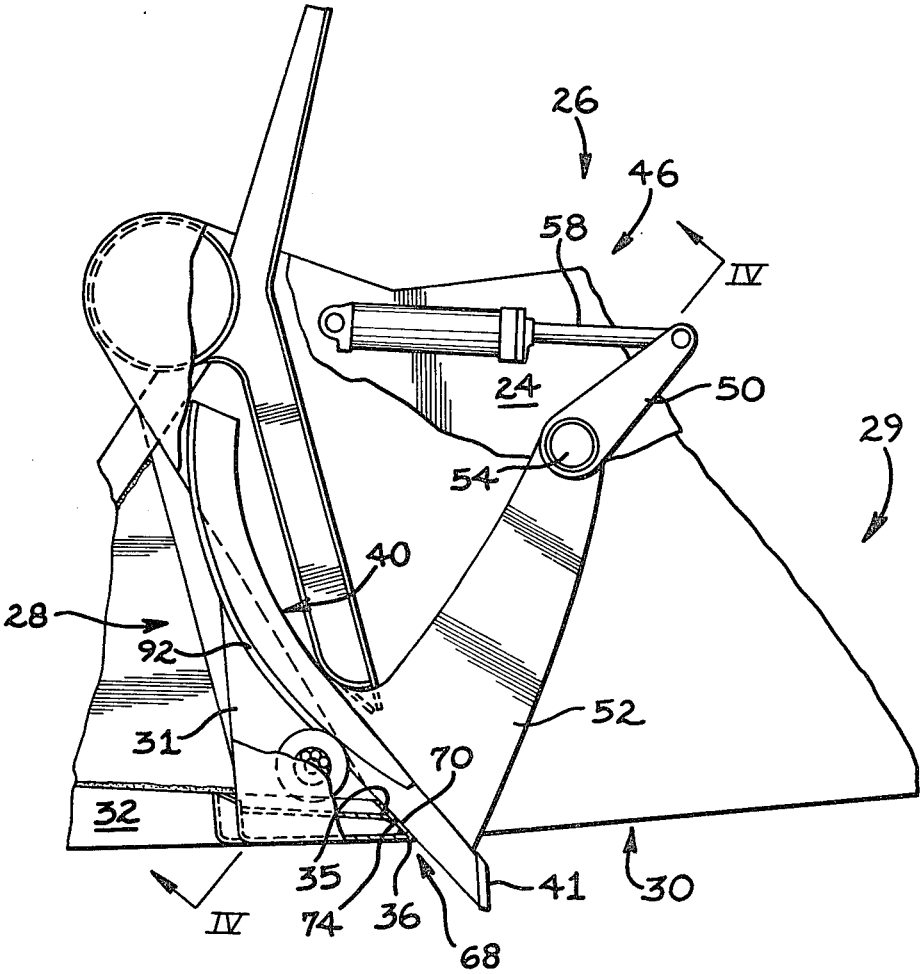
FIG. 3 is a diagramatic side elevational view similar to that of FIG. 2, but with a floor of the mobile scraper having been pivoted; and, FIG. 4 is a diagramatic cross-sectional view taken along line IV—IV of FIG. 3.

Referring to FIG. 3, pivoting apparatus 46 pivots floor 40 into its rearwardly directed, opening movement by cylinder rods 58 urging first arm 50 toward forward portion 29 of bowl 26, while second arm 52 pivots rearwardly toward rearward portion 28 of bowl 26. As scraper 10 traverses the terrain with floor 40 in its open position, striking edge 41 protrudes downwardly from bottom opening 30 and functions to level the discharged and discharging earth to a uniform height with respect to the ground.

Referring to FIG. 2, the present invention, denoted generally as an improved floor support embodiment, shall now be described. The floor support embodiment comprises support means 66 for positively supporting floor 40 from underneath, that is generally at underside 42, and by frame rails 32 when floor 40 is in the open position. Support means 66 reduces loading on pivoting apparatus 46, as will hereinafter be more fully described.

Support means 66 includes first means 68 for stopping floor 40 in the open position and for bearing horizontally directed forces imposed upon striking edge 41 when floor 40 is in the fully open position. The result of first means 68 is that floor 40 and its associated pivoting apparatus 46 are relieved of stresses which would otherwise tend to reduce the useful lives thereof.

Referring to FIGS. 2 and 3, first means 68 includes a longitudinally extending, rigid plate 70 which is affixed to rearward portion 28 of bowl 26 adjacent bottom opening 30. Plate 70 horizontally extends between sidewalls 24 and is affixed by means such as welding or the like, to each of gussets 31 and to frame ends 35 adjacent box sections 33. Plate 70 vertically downwardly terminates at lowermost portion 36 of frame rails 32.

First means 68 further includes a substantially planar surface 74 on underside 42 of floor 40 which cooperates with plate 70 when floor 40 is fully opened. Planar surface 74 of floor 40 is adjacent, preferably contiguous, to striking edge 41. Planar surface 74 contacts plate 70 when floor 40 has been rearwardly pivoted about axis 54. This contact between planar surface 74 and plate 70 positively stops floor 40 from further rearward pivoting, and thus defines a fully open position therefor.

FIG. 3 illustrates floor 40 in its fully open position with planar surface 74 bearingly abuting plate 70. Plate 70 is inclined at an angle of about 45° to ensure full, bearing contact between surface 74 and plate 70 when floor 40 is fully open. This contact is to distribute forces imposed upon striking edge 41 to frame rails 32, and further positively stops floor 40 from further opening.

Referring to FIG. 2, support means 66 further comprises second means 80 for supporting floor 40 in the closed position, open position, and during movement between open and closed positions. Second means 80 includes a pair of axially opposed rollers 82. Each roller 82 is affixed to a respective gusset 31. Rollers 82 (only one roller 82 being illustrated in FIG. 2, but both rollers 82 being illustrated in FIG. 4) are disposed above plate 70 so as to be a predetermined radial distance from pivot pin 54, which distance is less than the radial distance between plate 70 and pivot pin 54. Antifriction rollers 82 preferably have a hard, annular exterior surface 84 and are supported on shafts 85 connected to gussets 31. A plurality of bearings 86 support surfaces 84 upon shafts 85.

Rollers 82 engage a pair of spaced arcuate trackways 92 on underside 42 of floor 40 (only one trackway 92 being illustrated in FIGS. 2 and 3, but both trackways 92 being illustrated in FIG. 4). Trackways 92 are curved in a constant degree of curvature, that is hemispherical, whose radial dimension is substantially equivalent to the predetermined distance between rollers 82 and pivot pin 54.

Comparing FIGS. 2 and 3, it may be seen that trackways 92 of floor 40 are in continuous contact with surfaces 84 of rollers 82 during movement of floor 40 between the open and closed positions. Thus, when floor 40 is in its closed position and scraper 10 is loading, the vertically directed forces imposed by the earth accumulating upon closed floor 40 are to an extent borne by rollers 82, and also to an extent borne by second arm 52 of bellcrank 48. However, such vertically directed forces are not borne by cylinder rods 58. Then, as floor 40 is pivotted rearwardly, the substantially vertically directed forces of the discharging load against floor 40 are primarily borne by rollers 82 underneath floor 40, and distributed by rollers 82 to gussets 31 and frame rails 32. Thus, support means 66 provides that cylinder rods 58 never support the load weight, and shares the weight of floor 40 and the load thereon with pivotal mounting structure 45.

Referring to FIG. 2, it may be seen that an upper surface 98 of both box sections 33 (FIG. 2 illustrating one box section 33 which is identical to the other) slopes downwardly in two directions. The one sloping direction is from frame rail 32 generally toward sidewall 24. The other sloping direction is downwardly from rearward portion 28 toward forward portion 29. This slope provides clearance for rollers 82 to freely roll, while at the same time permits rollers 82 to be mounted on gussets 31 proximate the rigidly braced frame rails 32.

INDUSTRIAL APPLICABILITY

Support means 66 finds particular application in a self-loaded scraper, such as the above-described scraper 10. It should be obvious to those skilled in the art relating hereto that support means 66 will find other applications wherein it is desired to support the weight of a pivotally movable member which is subjected to considerable stresses, and to protect components of the pivoting apparatus therefor from bending, twisting or the like.

Referring to FIG. 1, as scraper 10 loads, earth emerges from auger mechanism 43 and is deposited into bowl 26 upon closed floor 40. Floor 40 is supported in its closed position by second arms 52 and pivot pins 54 upon sidewalls 24, and by rollers 82. As floor 40 is actuated to pivot rearwardly (compare FIG. 2 with FIG. 3), the cooperation between rollers 82 with trackways 92 provides positive support for floor 40. That is, substantially all of the force upon floor 40 during the transition of floor 40 between closed and open positions is imposed upon rollers 82 and frame rails 32. Accordingly, support means 66 shares the weight of floor 40 and the load thereon with pivotal mounting structure 45, and reduces the loading pivoting apparatus 46.

Referring to FIG. 3, when planar surface 74 of floor 40 contacts plate 70, then floor 40 is positively stopped from further opening. Further as scraper 10 proceeds to level the discharged earth, plate 70 bears the forces imposed upon striking edge 41. Accordingly, floor 40 is well supported in all operational positions, and stresses encountered thereupon are borne underneath floor 40 and by the rigid, braced frame rails 32.

I claim:

1. A mobile scraper (10), comprising:

a frame (32);

a bowl (26) connected to said frame (32), said bowl (26) having a bottom opening (30), a floor (40) and a pivoting apparatus (46) connecting said floor (40) to said bowl (26), said floor (40) being movable between a closed position at which said floor (40) closes said bottom opening (30) and an open position at which said floor (40) opens said bottom opening (30), said floor having a striking edge (41) being at a location below said frame (32) at the open position of said floor (40);

first means (68) for stopping said floor (40) at the open position and for supporting said floor (40) at a location adjacent said striking edge (41) and in a substantially horizontal direction; and, second means (80) for substantially vertically supporting said floor (40) on said frame (32) in the open position, the closed position and during movement therebetween.

2. In an earthworking scraper (10) having a frame (32), a bowl (26) mounted on said frame (32), said bowl (26) having a bottom opening (30), a floor (40), a pivoting apparatus (46) connecting said floor (40) to said bowl (26) and adapted to actuate movement of said floor (40), said floor (40) being pivotally movable between a closed position at which said floor (40) closes said bottom opening (30) and an open position at which said floor (40) opens said bottom opening (30), said floor (40) having a striking edge (41) which is below said frame (32) when said floor (40) is in the open position, the improvement comprising:

means (66) for positively supporting said floor (40) in the open position, the closed position and during movement therebetween, and for stopping said floor (40) at the open position and bearing horizontally imposed forces upon said striking edge (41) at the open position, said support means (66) including a plate (70) connected to said frame (32) and engagable with a surface (74) on an underside (42) of said floor (40) at a location adjacent said striking edge (41).

3. An earthworking scraper, as set forth in claim 2, wherein said plate (70) is at a location adjacent a lowermost portion (36) of said frame (32).

4. An earthworking scraper, as set forth in claim 2, wherein said support means (66) vertically supports said floor (40) on said frame (32) in the open position, the closed position and during moving of said floor (40) between open and closed positions.

5. An earthworking scraper, as set forth in claim 4, wherein said support means (66) includes a roller (82) and an arcuate trackway (92), said roller (82) being connected to said frame (32), said roller (82) being rollingly in engagement with said trackway (92).

* * * * *